United States Patent [19]

Uwai

[11] Patent Number: 4,924,217

[45] Date of Patent: May 8, 1990

[54] DRIVER CIRCUITS FOR DOT MATRIX DISPLAY APPARATUS

[75] Inventor: Hiroshi Uwai, Yokohama, Japan

[73] Assignee: Kabushiki Kaisha Toshiba, Kawasaki, Japan

[21] Appl. No.: 96,494

[22] Filed: Sep. 15, 1987

[30] Foreign Application Priority Data

Nov. 10, 1986 [JP] Japan ..... 61-265637

[51] Int. Cl.[5] ..... G09G 3/20; G09G 3/32

[52] U.S. Cl. ..... 340/782; 340/762

[58] Field of Search ..... 340/791, 782, 767, 762, 340/800, 801

[56] References Cited

U.S. PATENT DOCUMENTS 3,909,788 9/1975 Kaelin et al. .

3,973,254 8/1976 Nomiya et al. ..... 340/791

4,647,927 3/1987 Ichikawa et al. .

FOREIGN PATENT DOCUMENTS 0086619 8/1983 European Pat. Off. .

*Primary Examiner*—Alvin Oberley

*Attorney, Agent, or Firm*—Foley & Lardner, Schwartz, Jeffery, Schwaab, Mack, Blumenthal & Evans

[57] ABSTRACT

In a display apparatus having an LED dot matrix display unit (16×16 LEDs), shift registers, row drivers, a row select driver, etc., since the off-time of driver element (transistors) is relatively long as compared with high-frequency clock (about 15 MHz), LEDs are erroneously turned on. To overcome this problem, when LEDs for a row to be activated are scanned from the first row to the second row, for instance, the row select driver is disabled (LEDs are kept turned off) from when the first row select driver circuit is turned off to when the second last column register driver circuit (15th column register driver circuit) has been perfectly turned off. To eliminate the influence of a relatively long off-time of driver transistors as compared with the high-frequency clock in the dot matrix display apparatus, a current row select driver circuit is turned off a time period before a carry signal rises for storing image data and a succeeding row select driver circuit is turned on a time period after the carry signal falls.

3 Claims, 6 Drawing Sheets

DRIVER CIRCUITS FOR DOT MATRIX DISPLAY APPARATUS

BACKGROUND OF THE INVENTION

1. Field of the Invention

The present invention relates to a dot matrix display apparatus including a number of light emitting elements, and more specifically to an improvement of the dot matrix display apparatus in operation speed and image quality.

2. Description of the Prior Art

Dot matrix display apparatus (called display panel) have widely been used in various fields (e.g. as a panel for indicating Departure and/or Arrival Times of trains or aircraft at stations or airports). In these display panels, light emitting diodes (referred to as LEDs) are available and therefore IC circuits can be incorporated therewith because the LED driving voltage is relatively low. In addition, since LEDs of various colors (red, yellow, green, etc.) have been available, it is possible to realize a large-scale color display panel at a relatively low cost, as compared with the conventional cathode ray tube display apparatus (referred to as CRT).

In these display panels, it is ordinary that external video information signals are once stored in a memory unit and then displayed by activating the LEDs at relatively low speed. Therefore, it has been so far impossible to display images on the basis of video signals at high-speed in real time manner through the display panel configured by LEDs.

Recently, however, there exists a demand of displaying images indicated on a CRT of a personal computer simultaneously on this display panel in real-time fashion. In this case, since computers are usually operated in response to clock signals as high as 14 to 16 MHz, there exists a problem in that the conventional display panels of dot matrix type are not available to display images at high speed, because rise and fall times of LED driving transistors are relatively long as compared with the speed of the clock signal.

The problem involved in the prior-art dot matrix display apparatus will be described in further detail hereinafter with reference to the attached drawings under DETAILED DESCRIPTION OF THE PREFERRED EMBODIMENT.

SUMMARY OF THE INVENTION

With these problems in mind, therefore, it is the primary object of the present invention to provide a dot matrix display apparatus which can display clear images at high speed on the basis of video information signals and in response to high frequency clock signals.

To achieve the above-mentioned object, a dot matrix display apparatus having (a) at least one display panel unit having a plurality of light emitting elements arranged in matrix fashion; (b) at least one shift register for storing image data for each row in sequence in response to clock signals; (c) at least one row driver for activating the light emitting elements arranged in a row on the basis of image data stored in said shift register; (d) a counter for counting clock signals and outputting a carry signal whenever the counted clock signal exceeds the number of light emitting elements arranged in a row; (e) a carry counter for counting the carry signals and outputting a coded row selecting signal; (f) a decoder for decoding the coded row selecting signal, said decoder being disabled when a carry signal is being applied thereto; and (g) a row select driver for activating light emitting elements arranged in a predetermined row on the basis of the decoded row selecting signal, said row select driver also being disabled when a carry signal is applied to said decoder, according to the present invention, characterized in that the display apparatus further comprises a unit for disabling said decoder for a predetermined time period before and after the carry signal to increase the decoder disabling time period.

The predetermined time period ($T_5$) is an addition of carry signal pulse width ($T_2$) and substantially twice an off-time ($2T_3$) of driver elements constituting the row drive and the row select driver.

The decoder disabling unit is a bright signal generator for applying a disable signal to the decoder. The bright signal generator is adjustably activated in response to clock signals.

In summary, when LEDs to be activated are scanned from the first row to the second row, for instance, the row select driver is disabled (LEDs are kept turned off) from when the first row select driver circuit is turned off to when the second last column register driver circuit has been perfectly turned off.

BRIEF DESCRIPTION OF THE DRAWINGS

The feature and advantages of the dot matrix display apparatus according to the present invention will be more clearly appreciated from the following description of the preferred embodiment of the invention taken in conjunction with the accompanying drawings in which.

DETAILED DESCRIPTION OF THE PREFERRED EMBODIMENT

To facilitate understanding of the present invention, a reference will be made to a prior-art dot-matrix displaying apparatus, with reference to the attached drawings.

Figure 1:
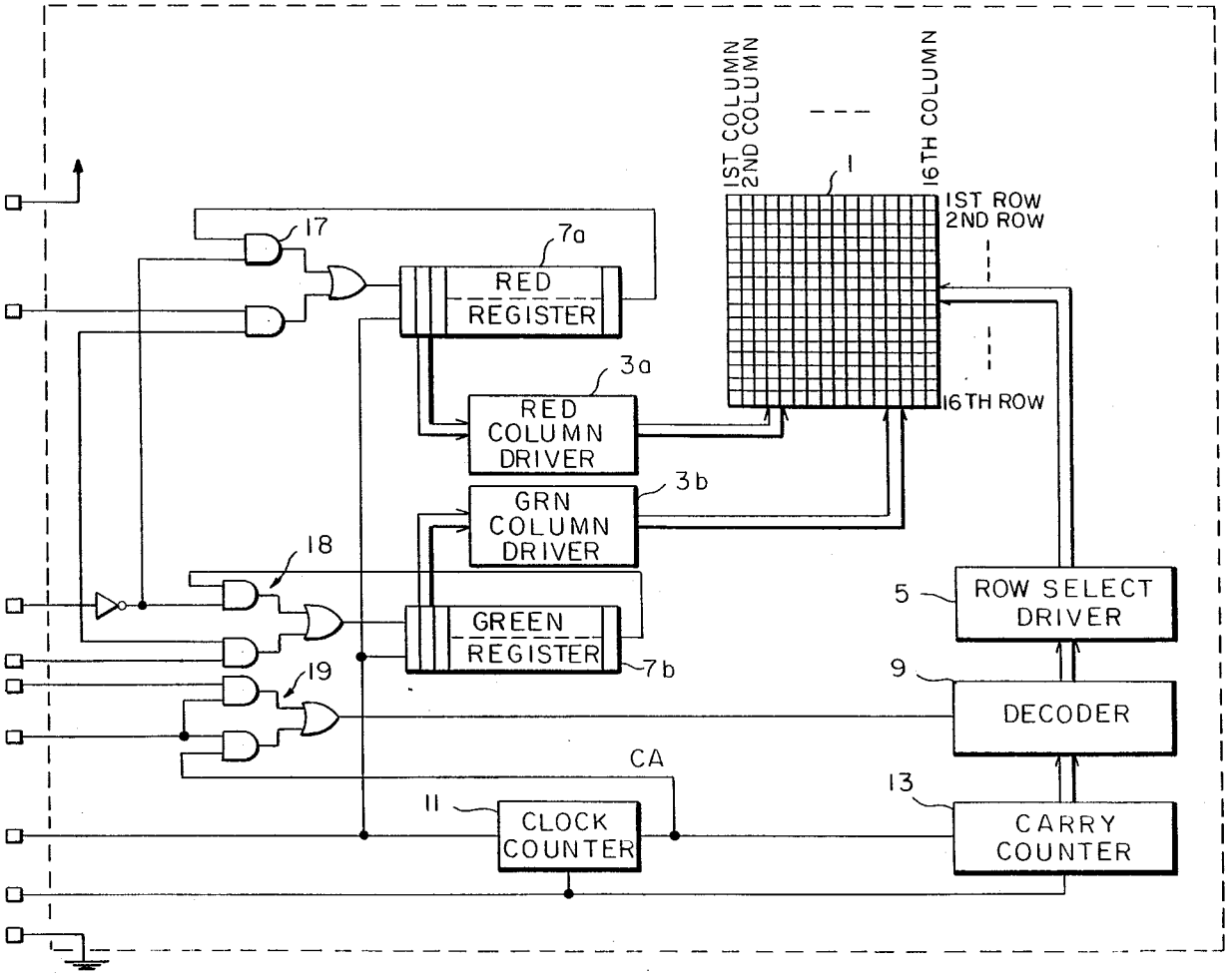
FIG. 1 (PRIOR ART)
FIG. 1 is a block diagram of a prior-art dot matrix display apparatus, to which the present invention is applied.

FIG. 1 shows a prior-art dot matrix display apparatus (display panel) using a number of light emitting diodes (LEDs). This display panel is roughly made up of a display unit 1, a red LED column driver 3*a*, a green LED column driver 3*b*, a row select driver 5, a red LED register 7*a*, a green LED register 7*b*, a decoder 9, a clock counter 11, a carry counter 13, and three logical gates 17, 18 and 19.

Figure 2:
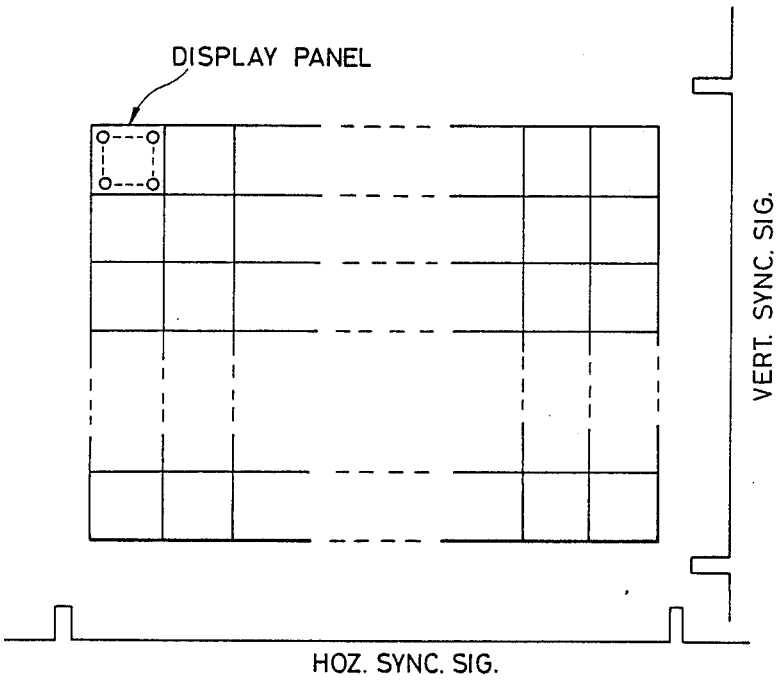
FIG. 2 (PRIOR ART)
FIG. 2 is a display unit formed by a plurality of display panel units.

The display unit can be configured by combining a plurality of the same display unit so as to provide a large-scale display panel as shown in FIG. 2. In this combined display unit, each unit 1 is scanned and selected on the basis of a horizontal synchronizing signal and a vertical synchronizing signal.

In FIG. 1, the display unit 1 is composed of 16×16 LEDs arranged in the horizontal (row) direction and in the vertical (column) direction. These LEDs are activated or turned on in response to image signals supplied from a personal computer, for instance. In the case where red and green image signals are both applied to the display unit 1, both red and green LEDs should be arranged at each of 16×16 dots.

The red LED column driver 3*a* is composed of 16 driver circuits (e.g. Darlington circuits) so as to turn on or off 16 red LEDs arranged in the horizontal direction separately; while the green LED column driver 3*b* is composed of 16 driver circuits so as to turn on or off 16 green LEDs arranged also in the horizontal direction separately. The row select driver 5 is also composed of 16 driver circuits so as to shift (or scan) 16 LED rows (driven by the red and green LED row drivers simultaneously) in the vertical direction.

The red shift register 7*a* stores red image data in synchronism with clock signals and shifts the stored data; while the green shift register 7*b* stores green image data in synchronism with clock signals and shifts the stored data.

The shift register 7*a* and 7*b* includes 16 storage areas (1st to 16th areas), each of which is connected to each of 16 driver circuits of the red or green LED driver 3*a* or 3*b*. The 16 image data are once stored in each corresponding storage area of the register 7*a* or 7*b* in response to clock signals only when a carry signal CA (described later) is at an H-voltage level and then simultaneously applied to the 16 LEDs arranged in the horizontal direction via the 16 driver circuits. In other words, 16 LEDs arranged in each row are activated at the same time by the drivers 3*a* or 3*b* on the basis of 16 image data stored in the register 7*a* or 7*b*.

The clock counter 11 counts the number of clock signals and outputs a carry signal CA to a carry counter 13 whenever 16 clock signals have been counted by the counter 11. The carry counter 13 counts the number of carry signals and applies a coded row selecting signal to the decoder 9 whenever a carry signal CA is inputted. The decoder 9 decodes the coded row selecting signal and selects one of 16 rows. For doing this, the decoder 9 selects one of 16 driver circuits of the row select driver 5. Therefore, when the row select driver selects a first LED row, for instance, the first row driver circuits of the row select driver 5 activates the first row LEDs so that the first row LEDs can be activated through the red or green row drivers 3*a* and 3*b* on the basis of image data stored in the registers 7*a* and 7*b*.

Further, in FIG. 1, when the data select signal is at an H-level, the register 7*a* or 7*b* stores red and green image data; when at an L-level, the register 7*a* or 7*b* will not receive external image data but holds the stored data in loop operation.

Further, the bright signal determines whether the display unit 1 is activated or deactivated, and adjusts the brightness of the turned-on LEDs. If the bright signal is at an L-level, the decoder 9 is enabled to activate the display unit 1; while if at an H-level, the decoder 9 is disabled to deactivate the display unit 1.

The reset signal initializes the display unit 1 only when set to an H-level. The enable signal permits the display unit 1 to be activated in response to the bright signal and the carry signal.

Figure 3:
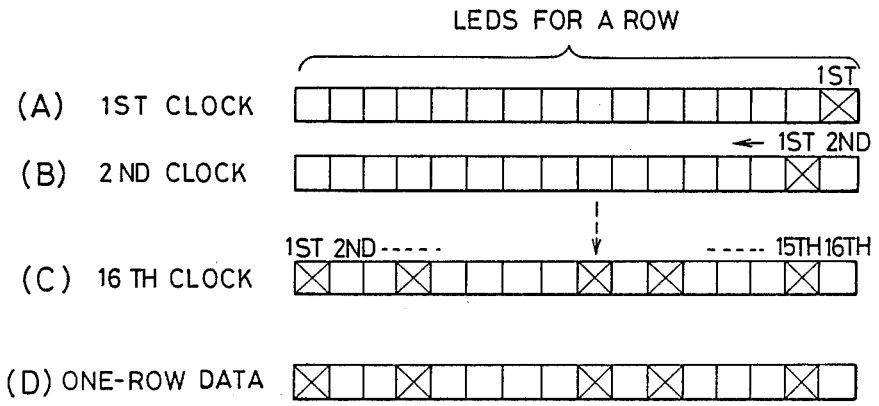
FIG. 3 (PRIOR ART)
FIG. 3 is a diagram for assistance in explaining one-row data stored and shifted by a shift register in response to clock signals.

In this connection, FIG. 3 illustrates the operation of the shift register 7*a* or 7*b*. In FIG. 3, when a first clock signal is applied to the register 7*a* or 7*b*, a first data ("0" or "OFF") is stored at the rightmost storage area of the register as shown by (A); when a second clock signal is applied to the register, the stored first data ("0" or "OFF") is shifted by one area in the leftward direction and a second data ("1" or "ON") is stored at the rightmost storage area as shown by (B) and so on; and when a 16th clock signal is applied to the register, all the stored data are shifted by one area in the leftward direction and the 16th last data is stored at the rightmost storage area as shown by (C). These 16 data for each column of a selected row are stored in the register as shown by (D) when the carry signal is kept at an "H" voltage level. The stored data are displayed on the display unit 1 via the driver 3*a* or 3*b* between the 16th and the 17th clock signals.

The operation of the display apparatus shown in FIG. 1 will be described with reference to FIG. 4.

When a reset signal is applied to the counters 11 and 13, these two counters are reset, and the lowmost row of the display unit 1 is automatically selected by the row select driver 5. Thereafter, 16 clock signals are applied in sequence. In response to the first clock, the clock counter 11 outputs a carry signal CA, so that the carry counter 13 is incremented and outputs a coded signal representative of a first LED row. The coded signal is decoded by the decoder 9 to select the first LED row. Further, in response to successive 16 clock signals, red (R) and green (G) signal data are stored and shifted in sequence in the shift registers 7*a* and 7*b*.

Under these conditions, since the driver circuits of the drivers 3*a* and 3*b* are activated by the data stored in the shift registers 7*a* and 7*b* and therefore a ghost image is displayed, the selected first-low LEDs are kept turned off, by applying a carry signal CA to the decoder 9, during a time period ($T_2$) from when a first data is stored to when a 16th (last) data is stored. That is, the row select driver 5 deactivates the display unit during the carry signal period ($T_2$).

After the 16 clock signals have been inputted and therefore 16 data are all stored in the register 7*a* or 7*b*, the 17th clock signal is applied after a time period ($T_1$) (this $T_1$ can be obtained by dividing a series of clock signals). In response to this 17th clock the carry counter 13 is incremented, so that the 2nd row driver circuit is selected by the driver 5. During this period ($T_1$), the data held in the register as first-row image data are displayed simultaneously. The above operation is repeated row by row to display an image on the display unit 1.

In the prior art display apparatus as described above, there exists a problem in that data stored in the register are not displayed correctly on the display unit 1, because of a relatively long off-time of the driver transistors. The reason will be described in further detail below.

The clock signals are as high as 14 to 16 MHz and further each driver is composed of a plurality of transistors. Therefore, transistor OFF-time (from when an off signal is applied to when the transistor is perfectly turned off) is longer than the time period ($T_2$) (FIG. 4) during which 16 clock signals are applied to the shift register 3*a* or 3*b* to store 16 image data.

Figure 4:
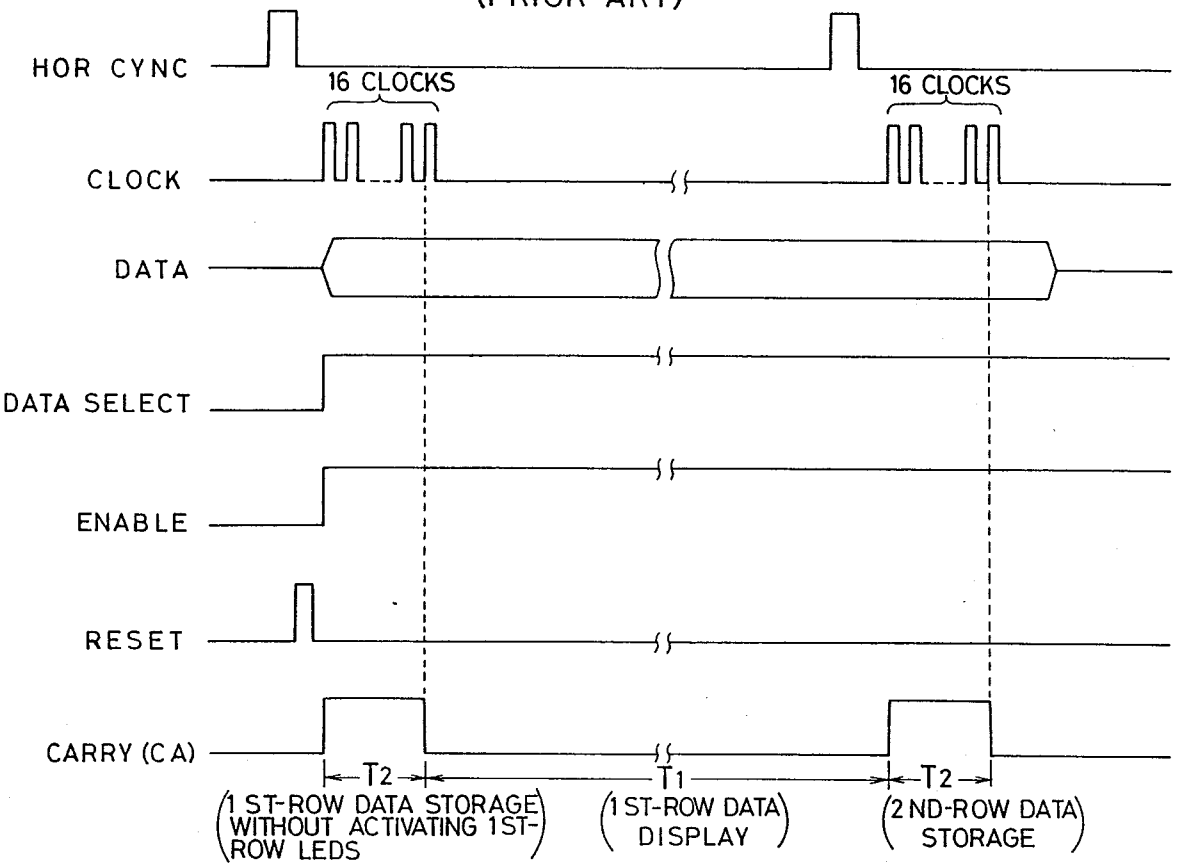
FIG. 4 (PRIOR ART)
FIG. 4 is a timing chart of signals generated in the display apparatus shown in FIG. 1.
Figure 5:
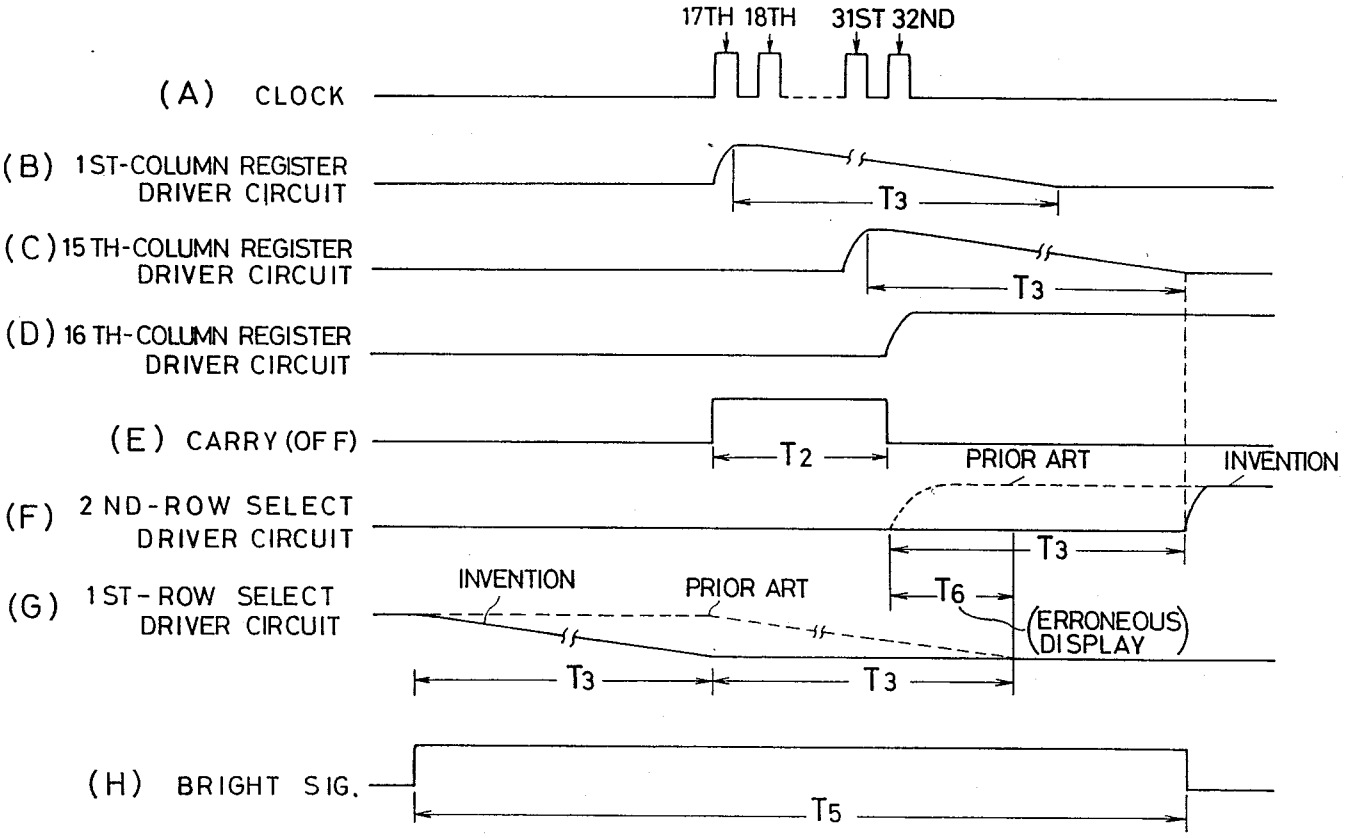
FIG. 5 are waveform diagrams for assistance in explaining the operation of the displaying apparatus shown in FIG. 1.

With reference to FIGS. 4 and 5, the carry signal rises in response to the 17th clock to turn off the 1st-row select driver circuit of the row select driver 5 as shown by dashed lines in FIG. 5(G). Further, the carry signal falls in response to the 33rd clock to turn on the 2nd-row select driver circuit as shown by dashed lines in FIG. 5(F). During this carry signal period ($T_2$), image data for the 2nd row LEDs are stored in the register *7a* or *7b* in sequence in response to 17th to 33rd clock signals, as shown in FIG. 5(B), (C) and (D). In FIG. 5, the 1st-column register driver circuit (not shown) stores the 1st-column LED image signal in the corresponding storage area of the register, when activated in response to the 17th clock. This circuit is deactivated when the 17th clock falls, and so on. However, the 16th-column register driver circuit (not shown) stores the 16th-column LED image signal in the corresponding storage area of the register, when activated in response to the 33rd clock. This circuit is kept activated.

As depicted in FIG. 5(F), during ($T_6$), the 1st and 2nd rows are both selected (activated) simultaneously, because the 1st-row select driver circuit is not perfectly turned off during the period ($T_3$), thus resulting in erroneous display operation. That is, 2nd-row LED data stored in response to the 17th clock and after are displayed on the 1st row.

On the other hand, in case the 16th column ON data is stored in the registers *3a* and *3b* in response to the 17th clock and the 15th column OFF data is stored therein in response to the 18th clock, for instance, these data are shifted in sequence in synchronism with the clock signals and therefore the 16th ON data is stored in the 15th area to turn on the 15th column row driver circuit. Thereafter, if the 16th ON data is shifted in response to the 23rd clock, the 15th column driver circuit is turned off and the 16th column driver circuit is turned on.

At this moment, an OFF time $T_3$ exists until the 15th column register driver circuit has been perfectly turned off, a data for originally turning on the 16th column LED erroneously turns on the 15th column LED for ($T_3$).

To overcome the above-mentioned problem, in the display apparatus of the present invention, the ON time at which the 2nd-row select driver circuit of the row select driver 5 (for selecting the 2nd-row) is turned on is delayed by ($T_3$) as shown in FIG. 5(F), so that the 2nd-row select driver circuit is turned on after the 15th column register driver circuit has been perfectly turned off. In addition, the OFF time at which the 1st-row select driver circuit (for selecting the 1st row) is turned off is advanced by ($T_3$), so that the 2nd-row data can be stored in the register in response to the 17th clock signal after the 1st-row select driver circuit has been perfectly turned off.

To achieve the above-mentioned operation, a bright signal is kept at a high voltage level for $(T_5)=(T_2)+(2T_3)$ as depicted in FIG. 5(H), in order to disable the decoder 9 for supplying a row select signal to the row select driver circuits.

The erroneous display operation occurs whenever the LED row is selected or scanned. Therefore, the bright signal width is widened for each LED row.

Figure 6:
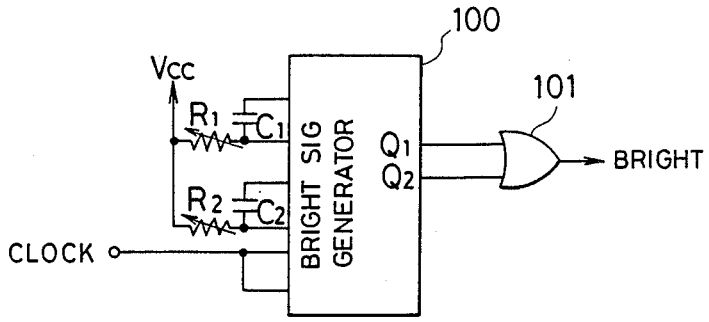
FIG. 6 is a block diagram showing an example of bright signal generator of the present invention.
Figure 7:
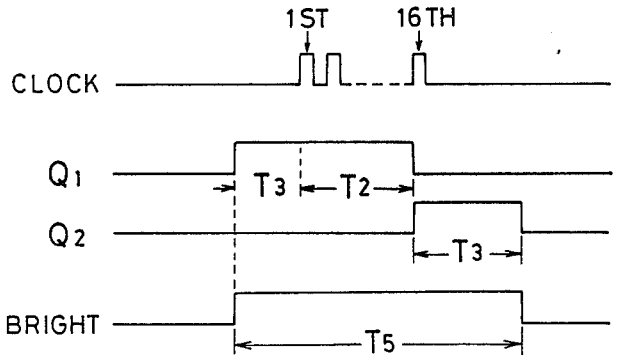
FIG. 7 is a timing chart of signals generated by the bright signal generator shown in FIG. 6.

FIG. 6 shows an example of a bright signal generator incorporated with the dot-matrix displaying apparatus according to the present invention. This bright signal generator 100 generates a bright signal with a pulse width ($T_5$) wider than a time period ($T_2$) between the 1st clock and the 16th clock by ($T_3$) on both the sides thereof.

In more detail, in response to an advance clock, a pulse signal $Q_1$ with a pulse width $(T_3)+(T_2)$ determined by a first time constant $R_1$ and $C_1$ is generated; while in response to the 16th clock, a pulse signal $Q_2$ with a pulse width ($T_3$) determined by a second time constant $R_2$ and $C_2$ is generated. These two pulse signals $Q_1$ and $Q_2$ are ORed to obtain a bright signal with a pulse width $(T_5)=(T_2)+(2T_3)$ through an OR gate 101. The pulse widths of these two pulse signals $Q_1$ and $Q_2$ are adjustable through variable resistors $R_1$ and $R_2$.

As described above, since LEDs arranged in the horizontal row direction are turned off for a predetermined time period ($T_5$) longer than the carry signal pulse width ($T_2$) when the LEDs are scanned in the vertical direction, even if image data are stored in the registers at high speed in response to high-frequency clock signal, it is possible to prevent erroneous display operation.

What is claimed is:

1. A dot matrix display apparatus comprising:

at least one display panel unit having a plurality of light emitting elements arranged in matrix fashion;

at least one shift register for storing image data for each row in sequence in response to clock signals;

at least one column driver composed of plural column driver circuits for activating the light emitting elements arranged in a row on the basis of image data stored in said shift register;

a counter for counting clock signals and outputting a carry signal to store data in the shift register without activating the row driver whenever the counted clock signal exceeds the number of light emitting elements arranged in a row;

a carry counter for counting the carry signals and outputting a coded row selecting signal;

a decoder for decoding the coded row selecting signal, said decoder being disabled when a carry signal is being applied thereto; and a row select driver composed of plural row driver circuits for selecting light emitting elements arranged in a predetermined row on the basis of the decoded row selecting signal, said row select driver also being disabled when the carry signal is applied to said decoder;

said display apparatus further comprises means for disabling said decoder for a predetermined time period before and after the carry signal to increase the decoder disabling time period in such a way that a current row driver circuit of the row select driver is turned off to deactivate the display panel unit being advanced by a time period from a carry signal rise time to store a first column data for a succeeding row in the shift register after the current row driver circuit has been turned off, and a succeeding row driver circuit of the row select driver is turned on to activate the display panel unit being delayed by said time period from a carry signal fall time to select a succeeding driver circuit of the row select driver after the last column driver circuit of the row driver has been turned off.

2. The dot matrix display apparatus as set forth in claim 1, wherein said decoder disabling means is a bright signal generator for applying a disable signal to said decoder.

3. The dot matrix display apparatus as set forth in claim 2, wherein said bright signal generator is adjustably activated in response to a clock signal.

* * * * *